US005317772A

United States Patent [19]

Perl et al.

[11] Patent Number: 5,317,772

[45] Date of Patent: Jun. 7, 1994

[54] INFLATABLE HEADREST

[76] Inventors: Zeev Perl; Ilan Perl, both of 32/4 Hamem-Gimel St., Jerusalem, Israel

[21] Appl. No.: 997,960

[22] Filed: Dec. 29, 1992

[30] Foreign Application Priority Data

Dec. 31, 1991 [IL] Israel ..... 100567

[51] Int. Cl.[5] ..... A47C 20/00

[52] U.S. Cl. ..... 5/644; 5/636; 297/395

[58] Field of Search ..... 5/644, 636, 630, 922; 247/397, 395

[56] References Cited

U.S. PATENT DOCUMENTS

| | | | |
|---|---|---|---|
| 3,220,770 | 11/1965 | Schaeffer | 5/636 |
| 4,206,945 | 1/1980 | Kifferstein | 5/922 |
| 4,738,488 | 4/1988 | Camelio | 5/636 |
| 4,815,154 | 3/1989 | Grimes | 5/644 |
| 4,951,998 | 8/1990 | McClain | 297/395 |
| 4,985,950 | 1/1991 | Gladish | 297/395 |

FOREIGN PATENT DOCUMENTS

| | | | |
|---|---|---|---|
| 1193084 | 3/1958 | France | 297/397 |
| 1477518 | 1/1966 | France | 297/395 |
| 1164314 | 6/1989 | Japan | 5/636 |
| 17685 | 11/1991 | PCT Int'l Appl. | 5/636 |
| 2194883 | 3/1988 | United Kingdom | 5/644 |

*Primary Examiner*—Flemming Saether

*Attorney, Agent, or Firm*—Lowe, Price, LeBlanc & Becker

[57] ABSTRACT

An inflatable pillow having fastening strips along one edge thereof is attachable to an external structure to enable easy attachment of the pillow to the structure, followed by inflation and use by a user. Suction cups may also be provided along the pillow edge for attachment to a vertical galss window.

4 Claims, 1 Drawing Sheet

INFLATABLE HEADREST

FIELD OF THE INVENTION

The present invention relates to an inflated hanging pillow for hanging upon vertical surfaces. More specifically the invention relates to an inflatable headrest to enable passengers in vehicles to lean their heads while travelling.

BACKGROUND OF THE INVENTION

Many passengers, when falling asleep during a journey, tend to lean and bump their heads against the car side or car window. This may endanger them and cause lasting damage (headaches etc.) in the future. Using any known pillow (either inflated or not) is not successful because the pillow tends to slide down along the vertical surface. The present invention relates to an inflatable pillow for passengers which can be hung upon vertical surfaces (e.g. car windows) to improve passengers comfort.

SUMMARY OF THE INVENTION

The present invention relates to an inflatable hanging pillow for hanging upon vertical surfaces, comprising an inflatable flexible compartment, strips with VELCRO attached to the upper rim of said compartment for sticking or hanging the pillow to regular seats made of cloth or any other material to which the VELCRO can stick, and vacuum clasps attached to said strips or to the upper rim of the inflatable compartment for attaching the pillow to a vertical glass window.

More specifically the vertical surface may be a car window or the head rest of a vehicle seat (including trains, buses, and airplanes seats).

DETAILED DESCRIPTION OF THE INVENTION

The present invention will be further described in detail by FIGS. 1 and 2.

Figure 1:
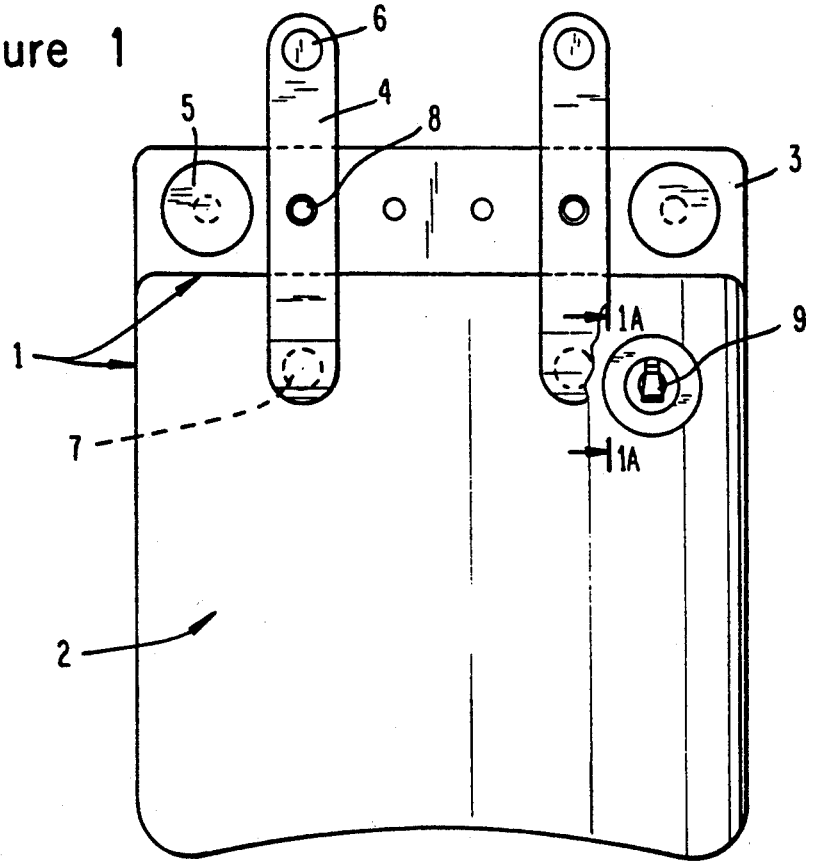
FIG. 1A is a sectional view taken along the line 1A—1A of FIG. 1; and is an illustration of a rear view of the pillow.

FIG. 3 represents the rear view of the pillow. The edges of the pillow are attached together by heating and tightening to form a compartment (2) which, when filled with air, will serve as the pillow's body. The preferred thickness of the pillow after it is filled with air is about 6–9 cm, depending on the amount of air.

In the upper part of the pillow there is a rim (3) along its entire width. At both ends of rim (3), vacuum clasps (5) and strips (4) are attached. At the upper inner side (6) of strips (4) and at their lower back side (7) VELCRO (Scotch TM tape) is sewn in, such that after the folding of the pillow (to the shape of cylinder) for storage the strips will surround the folded pillow and will be attached by the VELCRO. The strips (4) are attached at the edges by a fastener (8) enabling the movement of the strips around its axis.

The vacuum clasps can be attached also to the strips. The movement of the strips around its axis will enable the attachment of the vacuum clasps to the vertical surface at different angles relative to the pillow (in order to overcome the uneveness of the surface).

Figure 1A:
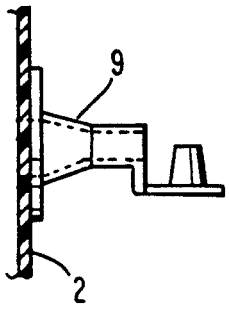

The hole for inflation (9) is located at the back of the pillow as best depicted in FIG. 1A. Said opening is standard such as in a sea mattress. It is possible to inflate the pillow either by blowing in air with one's mouth or by a manual blower. When inflated, the opening will be closed by a stopper attached to it.

Figure 2:
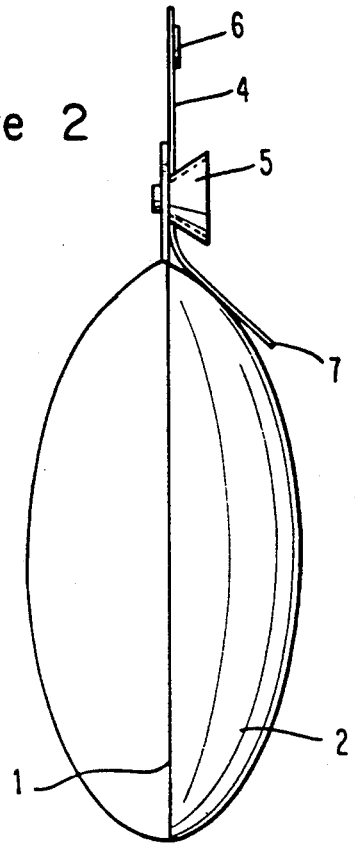
FIG. 2 is an illustration of the pillow in profile.

FIG. 2 illustrates the pillow (2) in profile inflated with air. The strips (4) with the VELCRO (6) and (7) and the vacuum clasps are attached to the upper part of the pillow.

It is possible to use the pillow according to the invention by attaching it by means of the strips and the VELCRO attached to them to regular seats made of cloth and/or any other material to which the VELCRO can stick. It is also possible to use the pillow in libraries, offices, etc. by hanging it on a smooth surface or alternatively by putting it on a table.

Additional advantages of the pillow: it is possible to adjust the pillow's hardness to the desirable degree by adjusting the amount of air the pillow contains. The pillow's structure enables its adjustment to uneven surfaces (for example in a vehicle—where the side window is surrounded by a frame). When the pillow is not in use it is possible to empty it of air and store it conveniently in a bag thus saving space and making it convenient to carry.

The pillow may be washed with a rag and soap.

The pillow is easy to carry. It can be made of synthetic velvet. Its preferred measurements are 35 cm long and 27 cm wide.

What is claimed is:

1. An inflatable pillow for hanging upon a vertical surface, comprising a generally rectangular inflatable flexible-walled compartment having along substantially the entire length of an upper edge thereof a non-inflatable rim to which is attached a second fastener having a fastening material for fastening the pillow to a seat having a covering mateable with said fastening material, and further including a first fastener attached to at least one of said second fastener and said non-inflatable rim for attaching the pillow to a vertical glass window;

wherein said second fastener is at least one strip secured at an intermediate portion thereof to the non-inflatable rim with opposite ends of said strip being loose free ends.

2. The inflatable pillow of claim 7, wherein said fastening material is provided at said opposite ends respectively on opposing surfaces of the strip so that said ends are mateable with each other, wherein said first fastener is a suction cup fastener.

3. An inflatable pillow, comprising an inflatable compartment wherein along one edge thereof there is integrally formed a non-inflatable rim to which is directly secured a first fastener which is at least one fastening element, and further including a second fastener which is at least one fastening strip having a different fastening element from said one fastening element and secured to said non-inflatable rim such that said different fastening element is spaced from said rim.

4. An inflatable pillow, comprising an inflatable compartment wherein along one edge thereof there is integrally formed a non-inflatable rim to which is attached a first fastener having a fastening material for fastening the pillow to a seat having a covering mateable with said fastening material, and further including a second fastener attached to at least one of said first fastener and said non-inflatable rim for attaching the pillow to a vertical glass window;

wherein said first fastener is at least one strip secured at an intermediate portion thereof to the non-inflatable rim with opposite ends of said strip being loose free ends.

* * * * *